US006443647B1

(12) United States Patent
Lerch et al.

(10) Patent No.: US 6,443,647 B1
(45) Date of Patent: Sep. 3, 2002

(54) INK FOLLOWER PISTON FOR A BALL-POINT PEN, AND A METHOD OF MANUFACTURING THE SAME

(75) Inventors: Jean-Philippe Lerch, Rouffach; José Duez, Boulonge sur Mer; Frédéric Bocquenet, Mulhouse, all of (FR)

(73) Assignee: Société BIC, Clichy (FR)

( * ) Notice: Subject to any disclaimer, the term of this patent is extended or adjusted under 35 U.S.C. 154(b) by 0 days.

(21) Appl. No.: 09/831,268

(22) PCT Filed: Nov. 9, 1999

(86) PCT No.: PCT/FR99/02740

§ 371 (c)(1), (2), (4) Date: May 9, 2001

(87) PCT Pub. No.: WO00/27651

PCT Pub. Date: May 18, 2000

(30) Foreign Application Priority Data

Nov. 9, 1998 (FR) ..... 98 14059

(51) Int. Cl.[7] ..... B43K 7/08

(52) U.S. Cl. ..... 401/142; 401/141

(58) Field of Search ..... 401/141, 142, 401/221, 222

(56) References Cited

U.S. PATENT DOCUMENTS 3,074,380 A * 1/1963 Polishuk ..... 401/142
3,082,740 A * 3/1963 Eckerle ..... 401/142
3,526,522 A * 9/1970 Seregely ..... 401/142
6,132,124 A * 10/2000 Ogura et al. ..... 401/142

* cited by examiner

*Primary Examiner*—David J. Walczak
(74) *Attorney, Agent, or Firm*—Antonelli, Terry, Stout & Kraus, LLP

(57) ABSTRACT

A follower piston for a ball-point pen, the piston including an element in the form of a stable gel whose hardness measured by cone penetration lies in the range $100\times10^{-1}$ mm to $400\times10^{-1}$ mm, and a method for manufacturing the element in situ.

38 Claims, No Drawings

INK FOLLOWER PISTON FOR A BALL-POINT PEN, AND A METHOD OF MANUFACTURING THE SAME

The invention relates to an ink follower piston for a ball-point pen and also to a method of manufacturing such a piston.

This type of piston comprises a gell element, optionally containing a solid element, and intended more particularly for use in combination with an ink of viscosity lying in the range 10 mPa.s to 30,000 mPa.s (or presenting thixotropic properties), the ink being placed in a reservoir fitted at one of its ends with a writing point.

Inks suitable for ball-point pens comprise three main groups, namely:

- aqueous inks that are liquid and of low viscosity, which are used in writing implements where flow rate regulation is provided by means of a system of baffles or a fiber reservoir;
- high viscosity inks in a solvent, used in tubular reservoirs that feed the tip directly; the flow rate in such pens being adjusted by modifying the viscosity of the ink; and
- aqueous inks of medium viscosity, used in tubular reservoirs that feed the tip directly.

In the third group, it is necessary to ensure that the ink does not flow out of the rear end of the reservoir cartridge by placing a follower piston on top of the column of ink. The piston is insoluble in the ink and is generally constituted by a plug of grease, thereby also serving to limit evaporation of any volatile solvents contained in the ink (water in particular), and to some extent serving to regulate the flow rate of the ball-point pen. Furthermore, when the pen is in use, the piston follows the column of ink along the tube, which is why it is referred to as a "follower", thus avoiding any residual ink deposits on the walls of the reservoir.

In the state of the art, various chemical compositions are mentioned for use as a follower piston and are formulated on the basis of one of or more low-volatility organic solvents, in particular polybutene, together with a thickening agent of the di- or tribenzylidene sorbitol type (JP 6220418) for forming grease that corresponds to a reversible semisolid state obtained by setting up physical internal bonds (such as hydrogen bonds and/or vanderWaals' bonds). In order to guarantee proper behavior in the tube, regardless of the conditions under which the pens are stored, these compositions generally have a high viscosity. In addition, while the pen is in use, these greases tend to adhere to the walls of the tube, thereby spoiling the appearance of the reservoir. Furthermore, such adhesion gives rise to a loss of material from, or to deformation of, the piston, thus causing the system to misfunction and running the risk of ink leaking out from the rear of the tube, and also the risk of the volatile solvents contained in the ink evaporating. Furthermore, in the event of an impact, the high viscosity of such follower pistons can lead to the column of ink becoming separated from the piston, giving rise to gaps in writing or indeed to a permanent stoppage.

In order to limit the negative effects due to the viscosity of the follower piston, various techniques have been investigated. These include incorporating an additive in the above-mentioned greases, which additive is of the poly (siloxane) modified polyether type (U.S. Pat. No. 5,348,989), or polar compounds (WO 98/04421) that are intended to improve sliding along the tube, and to guarantee better contact between the ink and the follower, in particular in the event of an impact.

Another solution, as envisaged in U.S. Pat. No. 4,671,691, consists in formulating viscoelastic grease compositions based on mineral oil, polybutene, and onium-treated organophilic clays. Such compositions which have high viscosity at rest can become substantially fluid under the effect of stress (normal flow in a tube or fast displacement of the follower piston in the event of an impact) so as to follow the ink better.

Nevertheless, the viscosities of such greases, even after shear, remain relatively high, thereby making them difficult to transfer, in particular when filling cartridges.

Furthermore, such greases made of a mixture of mineral oil and polybutene, are subject to large variations in viscosity as a function of temperature, such that a pen stored under conditions that vary significantly and that can sometimes be severe (tropical climates, back window of a car, ) can lead to the grease plug becoming liquid and can thus lead to the ink flowing out through the rear end.

Replacing the mixture of mineral oil+polybutene with silicone oils thickened by aluminum silicate, e.g. as in EP 0 792 759, always forms a grease whose viscosity is nevertheless not so sensitive to variations in temperature.

However, certain technical problems remain. Thus, it remains difficult to introduce such compositions of viscosity that is still high into cartridges, particularly when the tube diameter is small. In addition, the flexibility of all previously proposed solutions remains limited in that their properties must be matched to the characteristics of the intended pen, thus requiring the follower piston to be completely reformulated for each pen, and that is a lengthy effort.

Furthermore, those greases form pistons having excessive capacity for deformation which tends to disturb writing quality. In addition, those greases are opaque which makes the piston visible in a translucent or transparent tube or reservoir, and that is not satisfactory from the appearance point of view.

Finally, when the follower piston also has a solid element (as in FR 2 709 444), then the solid element is necessarily made with closed pores since the viscosity of the greases is too great for them to be able to penetrate into open pores. Such a configuration causes the solid element to float, thus making it particularly unstable.

Follower pistons developed in the context of the present invention are intended to solve the technical problems inherent in using conventional follower pistons.

SUMMARY OF THE INVENTION

According to the invention, this object is achieved by means of a first embodiment of a follower piston for a ball-point pen comprising, in particular, an element in the form of a stable gel of hardness measured by cone penetration lying in the range $100\times10^{-1}$ millimeters (mm) to $400\times10^{-1}$ mm.

DETAILED DESCRIPTION

In a particular variant, the gel element is made from a reaction medium containing at least one liquid component selected from silicone polymers, polyurethanes, polyesters, and epoxy resins.

Preferably, the reaction medium contains a first liquid component and a second liquid component of the same chemical nature and suitable for participating in a condensation or addition chemical reaction, and in particular in hydrosilylation.

In a particular embodiment, the first liquid component is constituted by at least one silicon polymer provided with at least two unsaturated ethylene functions.

In another embodiment, the second liquid component is constituted by at least one silicon polymer provided with at least two Si—H functions.

According to an advantageous characteristic, the molar ratio in the reaction medium of the unsaturated ethylene functions of the first component and of the Si—H functions of the second component lies in the range 1:5 to 5:1, and preferably in the range 1:3 to 3:1.

In another variant, the follower piston also includes a platinum-based hydrosilylation agent at a concentration such that the platinum content lies in the range 0.1 parts per million (ppm) to 1000 ppm.

According to an advantageous characteristic, the unsaturated ethylene functions are located at opposite ends of the chain of the silicone polymer of the first component.

According to another characteristic, said silicone polymer with an Si—H function of the second component is a copolymer of dimethylsiloxane and of methylhydrosiloxane.

In yet another variant, the piston further comprises a diluant agent constituted by at least one inert silicone polymer such as trimethylsiloxy-terminated poly (dimethylsiloxane).

In a specific variant, the piston further comprises at least one lubricating agent selected from white mineral oils and isoparaffin oils and/or fatty materials such as fatty acid esters, fatty alcohol esters, and triglycerides.

Preferably, the quantity of lubricating agent lies in the range 0.1% to 20% by weight of the gel, and lies preferably in the range 0.2% to 12% by weight.

In another variant, the piston also comprises a wetting agent constituted by at least one derivative selected from silicone derivatives, fluorine derivatives, and phosphate derivatives.

Preferably, said wetting agent is present in the gel in a quantity lying in the range 0.01% to 10% by weight of the gel, and preferably in the range 0.1% to 5% by weight.

In yet another variant, the follower piston further comprises a mineral filler constituted by finely divided silica present in a quantity lying in the range 0.1% to 20% by weight, and preferably in the range 0.5% to 10% by weight.

Another variant consists in adding pigments or dyes in the follower piston to a concentration lying in the range 0.1% to 20% by weight, and preferably in the range 0.5% to 10% by weight.

In another embodiment, the follower piston comprises a liquid or gel element in which there is included at least in part a porous solid element formed by extruding and cutting up a bar of plastics material obtained from a mixture of an expander agent and at least one component selected from polyolefins, polystyrene, and acrylonitrile butadiene styrene (ABS).

Preferably, said expansion agent is azodicarbonamide.

In yet another embodiment, the follower piston comprises a liquid or gel element in which a porous solid element is introduced at least in part, the solid element being formed by applying thermoadhesion to powdered high molecular weight polyethylene in a mold without compression.

In a variant embodiment, the follower piston is constituted by combining a gel element of the first embodiment and a solid element of the other embodiments set out above.

The invention also provides a method of making a follower piston as defined above in a pen of the type comprising a tube that forms an ink reservoir and that is fitted at one end with a tip carrier and a ball point, and characterized in that:

a liquid reaction medium is introduced into the tube via its open end remote from the point and above the ink, optionally while adding a catalyst;

where appropriate, a solid element is formed and is subsequently introduced into the tube into the liquid medium; and a gel element is produced by the liquid medium reacting chemically in situ.

In a first variant of the method, the reaction medium is prepared by mixing a first liquid component with a second liquid component of the same chemical nature and suitable for participating in a condensation or addition chemical reaction, and in particular hydrosilylation.

In another variant of the method, gelling of the liquid medium is accelerated by heat treatment at a temperature lying in the range 50° C. to 80° C. for a length of time lying in the range a few minutes to a few hours.

When the gel element of the piston of the invention is made from a medium constituted mainly by two reactive liquid components that are initially of low viscosity, it sets after the two reagents have been mixed at a rate which is a function of temperature conditions, so as to form a gel which is stable and homogeneous, having good mechanical behavior in the tube.

The liquid medium obtained immediately after mixing is easily transferred, which makes it easy to introduce into a reservoir and also easy to de-gas, regardless of the diameter of the tube. As a result, the interface between the ink and the follower piston is entirely clear and well-defined, thus making it possible to improve not only the visual appearance of the tube, but also adhesion between the column of ink and the follower piston, and consequently the ability of the piston to withstand any impacts to which the reservoir cartridge might be subjected, e.g. in the event of the pen being dropped.

In addition, the way in which follower pistons are made in the invention by post-gelling makes it possible to obtain compositions that are relatively hard and compact (having properties that are close to those of an elastomer). Unlike a grease, a gel corresponds to an irreversibly thickened state in which the internal bonds are chemical in nature being formed by cross-linking. Such gel pistons follow the displacement of the ink column accurately without leaving marks on the reservoir, and thus without losing thickness as they move due to writing. The follower piston of the invention conserves its properties from the beginning to the end of use of the cartridge (stability of the gel state, pen flow rate, permeability, ability to withstand impacts, mechanical strength of the follower piston in the tube). In addition, pistons formulated in a preferred embodiment, on the basis of silicone compounds, are subject to only small variations in hardness as a function of temperature.

Finally, it is observed that pistons of the invention are particularly flexible since their properties, and in particular their hardness, can be adjusted, specifically by varying the ratio between the two initial liquid components. Thus, a follower piston composition can be adapted to a particular writing implement without modifying its basic formulation.

Such a gel piston, optionally including a solid element, is preferably used in combination with an ink of low to medium viscosity, or that presents thixotropic properties, the ink being placed in a reservoir fitted at one of its ends with a tip and open at its other end. This prevents the ink from flowing out through the rear end of the reservoir/tube, limits evaporation of volatile solvents contained in the ink, and makes it possible to control the flow rate of the ball-point pen.

Naturally, it is also possible to implement the method of manufacturing the gel element starting from a medium that contains only one liquid component suitable for gelling in situ by a chemical reaction initiated by means either of physical treatment (such as irradiation, UV or heat treatment), or else by means of a cross-linking agent.

One way of manufacturing this follower piston is preferably implemented by mixing two distinct fluid reagents A and B, gelling, and then setting in situ to obtain a stable elastomeric gel structure that is homogeneous.

The first reagent A is then constituted by at least one silicone polymer having at least two unsaturated ethylene functions and possibly also including methyl, ethyl, phenyl, and/or 3,3,3-trifluoropropyl radicals. By way of example, this component A can be selected from the following:

vinyldimethyl-terminated poly(dimethylsiloxanes) having viscosity (at 25° C., like all of the other viscosities specified below) lying in the range 2 mPa.s to 1,000,000 mPa.s (e.g.: Petrarch System products PS 433, PS 445);

vinylphenylmethyl-terminated poly(dimethyl-siloxanes) of viscosity lying in the range 1000 mPa.s to 100,000 mPa.s (e.g.: Petrarch System product PS 463);

divinylmethyl-terminated poly(dimethylsiloxanes) of viscosity lying in the range 1000 mPa.s to 100,000 mPa.s (e.g.: Petrarch System products PS 483, PS 488);

dimethylsiloxane- and vinyldimethyl-terminated methylvinylsiloxane copolymers (e.g.: Petrarch System product PS 483);

dimethylsiloxane- and trimethylsiloxy-terminated methylvinylsiloxane copolymers of viscosity lying in the range 250 mPa.s to 300,000 mPa.s; and dimethylsiloxane- and vinyldimethyl-terminated diphenylsiloxane copolymers of viscosity lying in the range 500 mPa.s to 150,000 mPa.s (e.g.: Petrarch System products PS 735, PS 736, PS 784).

It is preferable to use silicon copolymers or polymers terminated by a plurality of vinyl functions, of viscosity lying in the range 200 mPa.s to 165,000 mPa.s, and preferably in the range 1000 mPa.s to 5000 mPa.s, and containing a minimum of 50% dimethylsiloxane units.

Where appropriate, the content in vinyl groups in the product, depending on the viscosity of the polymer, lies in the range 0.025 mMol/g to 0.300 mMol/g.

The polymers can contain up to 3% volatile substances.

The second reagent B is constituted by at least one silicone polymer provided with at least two Si—H functions.

By way of example, the silicone polymer can be selected from the following:

polymethylhydrosiloxane of viscosity lying in the range 1 mPa.s to 1000 mPa.s (e.g.: Petrarch System products PS 118, PS 122);

dimethylsiloxane and methylhydrosiloxane copolymers of viscosity lying in the range 10 mPa.s to 100,000 mPa.s (e.g.: Petrarch System products PS 123, PS 124);

phenylmethylsiloxane and methylhydrosiloxane copolymers of viscosity lying in the range 10 mPa.s to 1000 mPa.s (e.g.: Petrarch System product PS 128.5); and a polymethylsiloxane carrying a terminal hydrogen atom, of viscosity lying in the range 1 mPa.s to 20,000 mPa.s (e.g.: Petrarch System products PS 542, PS 545).

By mixing with component A in a liquid medium and by the hydrosilylation reaction, component B makes it possible to form a three-dimensional lattice which gives rise to the "homogeneous stable gel" state.

For component B, it is preferable to use a polymethylhydrosiloxane polymer or a dimethylsiloxane and methylhydrosiloxane copolymer having a minimum of three methylhydrosiloxy groups per molecule, and viscosity lying in the range 20 mPa.s to 10,000 mPa.s.

The quantities of the components A and B are adjusted in such a manner that the ratio between the number of moles of vinyl or unsaturated ethylene functions and the number of moles of Si—H functions lies in the range 1:5 to 5:1 and preferably in the range 1:3 to 3:1.

In order to make the hydrosilylation reaction possible, or to accelerate it, or to significantly improve its efficiency, a catalyst C should be added to the mixture of A+B.

By way of example, the catalyst C can be selected from the following:

a platinum/divinyltetramethyldisiloxane complex in solution in a solvent (e.g.: Petrarch System product PC 072);

a platinum/divinyltetramethyldisiloxane complex mixed in a solution of vinyl-terminated polydimethylsiloxane (e.g.: Petrarch System product PC 075); and a platinum/cyclovinylmethylsiloxane complex in solution in a cyclic vinylmethylsiloxane (e.g.: Petrarch System product PC 085).

The catalyst should be present at a quantity which is sufficient to provide platinum at a concentration lying in the range 0.1 ppm to 1000 ppm.

The liquid reaction medium preferably comprises a diluant agent (I). This diluant agent is constituted by an inert silicone polymer that can be selected, for example, from the following:

polydimethylsiloxane of viscosity lying in the range 1 mPa.s to 2,500,000 mPa.s, and preferably lying in the range 10 mPa.s to 1,000,000 mPa.s (e.g.: NM1 oils from Sivento);

polyphenylsiloxane;

polymethylphenylsiloxane; and dimethylsiloxane and diphenylsiloxane copolymer of viscosity lying in the range 50 mPa.s to 500,000 mPa.s (e.g.: Petrarch System products PS 160, PS 162).

It is preferable to use silicone polymers or copolymers terminated by trimethylsiloxy groups.

The polymer which acts as a diluant in the composition makes it possible to refine the initial properties of the liquid medium (viscosity) and the final properties of the gel (hardness, lubricating properties).

In some cases, it can be advantageous to add one or more other additives to the composition for the piston, such as the following in particular:

a filler material D selected, for example, from silicas, talcs, and calcium carbonates.

It is preferable to use finely divided silica that is, for example, micronized, optionally being subjected to hydrophobic treatment, with the filler representing 0.1% to 20% by weight and preferably 0.5% to 10% by weight.

This filler makes it possible to adjust the physical properties of the gel (hardness in particular) and to reduce the adhesion of the gel on the wall of the pen's tube/reservoir.

In a variant of the invention, the system (A+B+C+D+I) could be constituted by two-component silicone systems that are suitable for setting at ambient temperature such as Sivento products in the ranges NG 3712, NG 3714, or NG 3716 (sold by Huls silicones).

It can also be advantageous in some cases to add one or more lubricating agents E to the composition for the piston, said agents being selected from the following:

white or transparent mineral oils (e.g.: Semtol oils of 70/28 type based on hydrocarbons sold by Witco);

isoparaffin oils; and fatty substances such as esters of fatty acids, esters of fatty alcohols, triglycerides.

It is preferable to use a mineral oil that is compatible with the gel, i.e. that does not present problems of exudation, at a concentration lying in the range 0.1% to 20% by weight, and preferably in the range 0.2% to 12% by weight.

The lubricating agent also ensures that the gel piston follows the ink well in the tube, by limiting its adhesion with the walls.

This agent can be added to the liquid medium containing the components A and B, and it can be added equally well before mixing or immediately after mixing. Nevertheless, substances that might contain sulfur-containing compounds or amine-containing compounds or any other compounds that could poison the hydrosilylation catalyst C are preferably added immediately after A and B have been mixed together so as to retain constant activity for the catalyst over a long storage period.

In another variant of the invention, it can be advantageous to add a wetting agent F to the composition so as to provide cohesion between the column of ink and the follower piston, thus improving the ability of the assembly to withstand impacts.

By way of example, the additive can be selected from the following:

silicone derivatives;

fluorine derivatives; and phosphate derivatives.

This additive is used at a concentration lying in the range 0.01% to 10% by weight, and preferably in the range 0.1% to 5% parts by weight. The additive is preferably added immediately after A and B have been mixed together.

In yet another variant of the invention, it can be advantageous to add a coloring material G to the composition, where G is selected from the following, for example:

organic pigments: azo dyes, phthalocyanines, quinacriolon;

inorganic pigments: titanium dioxide, iron oxide; and organosoluble dyes: Solvent Red 27, Solvent Blue 35.

This additive G is preferably added immediately after A and B have been mixed together and it is used in such a manner that the quantity thereof lies in the range 0.1% to 20% by weight, and preferably in the range 0.5% to 10% by weight.

In the invention, other gelling reactions could be implemented to form the follower piston. These reactions 5 and the substances involved are described, for example, in U.S. Pat. No. 5,079,300 (Dubrow et al.) and comprise, for example:

(i) a reaction between silanol and silane functions:

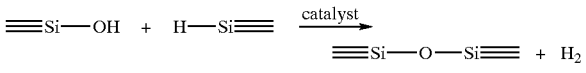

(ii) a reaction between silanol and alkoxy functions:

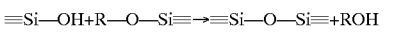

(iii) a reaction between silanol and enoxy functions:

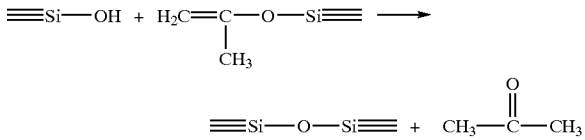

(iv) a reaction between silanol and amine functions:

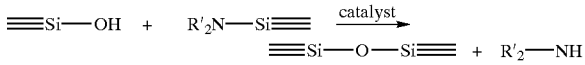

(v) a reaction between silanol and oxime:

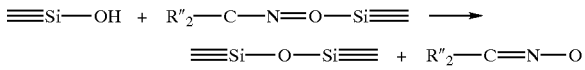

More generally still, the gel follower piston can be formed by an optionally catalyzed chemical reaction between two components A and B selected from the following systems:

polyurethanes: e.g. described in U.S. Pat. Nos. 4,600,261 and 4,634,207;

epoxy;

polyester;

polybutyls; and polyacrylics.

In another variant of the invention, it can be advantageous to add an inhibitor H to the hydrosilylation reaction so as to increase the duration over which liquid components A can be conserved. This inhibitor can be selected, for example, from the following:

dialkyl decarboxylates (as in U.S. Pat. No. 4,256,870, U.S. Pat. No. 4,476,166);

dialkyl acetylene-dicarboxylates (as in U.S. Pat. No. 4,347,346);

acetylene alcohols (as in U.S. Pat. No. 3,989,866 and U.S. Pat. No. 4,336,364);

benzotriozol derivatives; and short chain vinylsiloxanes.

The gel follower pistons obtained in this way are characterized by hardness values corresponding to cone penetration values lying in the range $100\times10^{-1}$ mm to $400\times10^{-1}$ mm, and preferably in the range $200\times10^{-1}$ mm to $360\times10^{-1}$ mm (measurements performed at 25° C. using a Petrotest PNR10 penetration meter, fitted with a 102.5 gram (g) cone and a 47.5 g guide, in application of the DIN 51580 standard).

In addition, the resulting homogeneous gel can also be "reinforced" or "consolidated" by a solid element that is inserted at least in part into said gel element or in any of the liquid elements forming the support, in which, although stable, it nevertheless conserves a small amount of relative mobility. This embodiment presents a particular advantage in the event of the gel having a tendency to deform in the center. By way of example, this phenomenon can be observed on reservoirs of large diameter, when the follower piston gel element is subjected to suction caused by the ink flowing towards the tip.

In order to provide this function, the solid element must have apparent density that is less than or equal to the density of the liquid element or gel. However, the shape of the solid element and its color (white or colored) can be arbitrary, and its section can be cylindrical or polygonal (square, triangular, hexagonal). Furthermore, the solid element is porous and can include coaxial recesses providing better matching of its apparent density.

The solid element can be made of various materials, mixed together or superposed, e.g. by adhesive or heat-sealing. The solid element is preferably manufactured using one of the following two methods:

1) By extrusion and chopping up a bar of plastics material obtained from a mixture of at least one component selected from polyolefins and polystyrene with an expander agent that is preferably constituted by azodicarbonamide. Under the effect of temperature, the expander agent decomposes releasing bubbles of gas (nitrogen), thereby creating "closed pore" type pores within the material. The density of the solid element is adjusted by an appropriate selection for the base material and for the quantity of expander agent introduced therein, so that it comes automatically flush with the surface of the liquid element or gel. Thus, it is possible for the solid element to be provided with an apparent relative density lying in the range 0.5 to 1.0 or even more if the plastics material is initially filled. Where appropriate, the moving solid element is used in combination with liquid or gel elements of relative density lying in the range 0.8 to 1.1.

2) By thermoadhesion applied to powders of high molecular weight polyethylene, such as, for example, Hostalen GUR 8020 from Targor (sold by Hoechst), with the thermoadhesion being performed in a mold without compression. Under the effect of heat, such powders melt on the surface and their grains adhere to one another so as to constitute a porous array made up of "open" pores. Under such circumstances, the density of the solid element is determined by the nature of the material constituting it so as to ensure that the solid element is positioned at the surface of the liquid or gel support element. Density is maintained at a value which is slightly less than that of the support element, thus allowing it to penetrate into the pores.

Follower pistons developed in the context of the present invention can be used in ball-point pens that have tubes/reservoirs of various diameters lying in the range 1 mm to 30 mm, or even more.

Such ball-point pens are manufactured in various steps:

initially, the ink reservoir forming tube is provided at one end with a tip carrier and with a ball point;

thereafter, the ink is introduced into the reservoir; and the reactive liquid medium is then prepared, e.g. by mixing components A and B, the catalyst C, and the additives D to I in predetermined ratios. The reactive medium can also be constituted by a single component associated with an agent or a treatment for gelling purposes.

In a first method, the reactive mixture obtained in this way is immediately introduced into the ink-containing tube/reservoir through its end remote from its tip, by means of at least one metering pump (not shown). In another method, the follower piston is introduced into the tube by means of two metering pumps after continuous mixing and reaction initiation. This second method prevents the gel hardening in the reservoir in the event of an assembly line being stopped. In any event, the rates of reaction between the various components in the liquid medium are relatively slow, so the gel element is formed by chemical reaction essentially in the tube/reservoir, i.e. in situ, and not during transfer of the liquid medium.

When so required by the characteristics of the pen, a solid element of the type described above can be introduced in the liquid medium:

when the solid element has open pores, then the liquid medium penetrates into its porous structure and fills it pores, thereby increasing its density and stabilizing it;

the tube containing the ink and the follower piston is then degassed by centrifuging, while the liquid medium is still sufficiently fluid; and during a finishing step, the gel element of the follower piston is subjected to an operation of accelerated setting by application of heat, at a temperature lying in the range 50° C. to 80° C. Depending on the selected gelling conditions, this operation can require a few minutes to a few hours.

EXAMPLES

The following examples are not limiting. All of the quantities referred to are magnitudes given in terms of mass.

The effectivenesses of the follower pistons mentioned in Examples 1 to 14 and in comparative Examples 1 to 2 were evaluated using ball-point pens made as follows:

a reservoir tube having an inside diameter of 5.0 mm was filled with ink (see Table 1) to form a cartridge;

the point was fixed to the pen;

the follower piston was introduced into the cartridge in the form of a reactive liquid medium or a grease (for the comparative Examples) with viscosity lying in the range 10 mPa.s to 10,000 mPa.s; and the cartridge was centrifuged at 2000 revolutions per minute (rpm) for 10 minutes (min).

The formula of the ink used when preparing these cartridges is as given in Table 1 below:

TABLE 1

| Ingredients | Quantities (% by weight) |
|---|---|
| Coloring matter | 8.0 |
| Water | 68.9 |
| Cosolvent | 20.0 |
| Resin | 2.0 |
| Anti-corrosion agent | 1.0 |
| Bactericide | 0.1 |

Embodiments of follower pistons of the invention are given in the following Examples:

Example 1

A gel follower piston of the invention was obtained by mixing two liquid substances manufactured and sold by Sivento under formulation referenced NG3712 S3.

Reagent No. 1

Fraction (1) of component A, 29.0% of vinyl-terminated polydimethylsiloxane having viscosity of 1000 mPa.s.

Fraction (1) of diluant (I), 67.9% of trimethylsiloxy-terminated polydimethylsiloxane of viscosity 1000 mPa.s.

Component C, 0.2% of a catalyst containing 1% platinum.

Component D, 2.9% of hydrophobically-treated silica.

Reagent No. 2

Fraction (2) of component A, 48.1% of vinyl-terminated polydimethylsiloxane of viscosity 1000 mPa.s.

Fraction (2) of diluant (I) 48.5% of trimethylsiloxy-terminated polydimethylsiloxane having viscosity of 1000 mPa.s.

Component B, 0.5% of a dimethylsiloxane and methylhydrosiloxane copolymer, containing 0.7% methylhydrosiloxane groups.

Component D, 2.9% hydrophobically-treated silica.

The two liquid substances 1 and 2 were mixed under high stirring so that the ratio by weight of substance No. 1 to substance No. 2 was 1.32. The liquid reaction medium resulting from mixing was introduced into the reservoir of the pen above the ink. The assembly was then centrifuged for 10 min at 2000 rpm and then stored at 50° C. for 18 hours to ensure that the follower piston gelled completely.

Table 2 summarizes examples of follower pistons of the invention.

Comparative Example 2

| | |
|---|---|
| Polybutene | 41.0% |
| Mineral oil | 55.7% |
| Aluminum stearate | 3.3% |

TABLE 2

| COMPONENTS | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 |
|---|---|---|---|---|---|---|---|---|---|---|---|---|---|---|
| REAGENT 1 SIVENTO NG 3712 S3 | 57% | 20% | 15% | 15% | | | | | | | | | | |
| REAGENT 2 SIVENTO NG 3712 S3 | 43% | 30% | 30% | 30% | | | | | | | | | | |
| REAGENT 1 SIVENTO NG 3712 S6 | | | | | 50% | 27.5% | | | | | | | | |
| REAGENT 2 SIVENTO NG 3712 S6 | | | | | 50% | 22.5% | | | | | | | | |
| REAGENT 1 SIVENTO NG 3712 S7 | | | | | | 27.5% | | | | | | | | |
| REAGENT 2 SIVENTO NG 3712 S7 | | | | | | 22.5% | | | | | | | | |
| REAGENT 1 SIVENTO NG 3712 S8 | | | | | | | 50% | 54% | | | | | | |
| REAGENT 2 SIVENTO NG 3712 S8 | | | | | | | 45% | 41% | | | | | | |
| REAGENT 1 SIVENTO NG 3712 S1 | | | | | | | | | 17% | 66,7% | | | | |
| REAGENT 2 SIVENTO NG 3712 S1 | | | | | | | | | 83% | 33,3% | | | | |
| REAGENT 1 SIVENTO NG 3716 S1 | | | | | | | | | | | 50% | 45% | | |
| REAGENT 2 SIVENTO NG 3716 S1 | | | | | | | | | | | 45% | 45% | | |
| REAGENT 1 SIVENTO NG 3716 S4 | | | | | | | | | | | | | 50% | 45% |
| REAGENT 2 SIVENTO NG 3716 S4 | | | | | | | | | | | | | 50% | 55% |
| E/ Silicon oil NM 1.1000 | | 50% | | | | | | | | | | | | |
| E/ Silicon oil NM 1.5000 | | | 55% | | | | | | | | | | | |
| E/ Silicon oil NM 1.10000 | | | | 55% | | | | | | | | | | |
| E/ Isoparaffin oil SEMTOL | | | | | | | 5% | 5% | | | 5% | 10% | | |
| GELLING CONDITIONS | | | | | | | | | | | | | | |
| at 50° C. | 18 h | 18 h | 18 h | 18 h | 12 h or 4 days | 4 h or 4 days | 4 h or 2 days | 4 h or 2 days | 20 h or 7 days | 20 h or 7 days | 4 h or 2 days | 4 h or 2 days | 4 h or 2 days | 4 h or 2 days |
| at 22° C. | | | | | | | | | | | | | | |
| at 20° C. | | | | | | | | | | | | | | |

Two single-component follower piston compositions of prior art grease type were evaluated in parallel with the two-component embodiments of the invention.

Comparative Example 1

| | |
|---|---|
| Silicone oil NM1.5000 | 94.6% |
| Hydrophobically-treated micronized silica | 5.2% |
| Polyether modified silicone wetting agent | 0.2% |

Silica was dispersed in the oil under strong mechanical stirring, so as to obtain a perfectly uniform grease.

The grease prepared in this way by mixing was subsequently milled.

The follower pistons described below were then subjected to various tests:

Evaluating the Viscosity of the Initial Liquid Mixture

This viscosity was measured at 20° C. at 1,$S^{-1}$ with a Haake Rheostren RS150 flow meter fitted with a cone and plate system of type C60/1 (for Examples 1 to 14) or type C20/1 (for Comparative Examples 1 and 2).

Evaluating the Method of Making the Follower Piston in the Tube/Reservoir

The following scale was used to evaluate in qualitative manner how easy it was to perform the operations of transferring, introducing into the tube/reservoir of the ball-point pen, and degassing the follower piston. The scale on which these criteria were accessed is as follows:

4: transfer, introduction into the tube, and degassing easy

3: transfer, introduction into the tube easy, degassing medium

2: transfer easy, introduction into the tube and degassing medium

1: transfer, introduction into the tube and degassing possible, but difficult

0: transfer, introduction into the tube and degassing very difficult or impossible Performance of the Piston Effect on the Ink The piston effect performance of the follower piston on the ink was investigated by subjecting the ball-point pen to an automatic writing test covering 4×100 m of writing, by measuring the ink flow rate once every 100 m. This serves to evaluate the regularity of writing, by considering the way in which the flow rate from the pen varied between 100 m and 400 m, as follows:

4: flow rate variation≦2%

3: 2%<flow rate variation≦5%

2: 5%<flow rate variation≦10%

1: 10%<flow rate variation≦15%

0: flow variation≦15%

Ball-point Pen Appearance

The appearance of the ball-point pen was evaluated on the following two criteria:

The appearance of the tube (or "clear-drain") after a given length of ink column and follower piston had been used up (in our case 400 m of automatic writing). This test was marked as follows:

4: no mark on tube

3: presence of follower piston residue in its initial position

2: presence of small marks of follower piston and/or ink

1: presence of considerable marks of follower piston and/or ink along the tube

0: tube regularly marked by the follower piston and/or the ink

Appearance of the ink/follower piston interface before and after 400 m of writing:

4: interface perfectly regular and horizontal

3: interface regular but inclined

2: interface very regular

1: interface irregular, relatively horizontal

0: interface irregular including crater(s) and/or air bubble(s).

Ability of Ball-point Pen to Withstand Impact

In order to investigate the ability of pens to withstand impacts, they were dropped three times over from a height of 1.5 m onto a concrete floor, so as to receive an impact via the rear end. Each pen was evaluated after being subjected to impacts, using the following scale:

4: system unchanged, writing possible immediately

3: ink plus follower piston set back slightly, start of writing slightly retarded 2: small setback and follower piston deformed 1: follower piston set back and/or deformed considerably 0: ink flowed out of the rear of the tube Influence of Temperature a) Viscosity In order to judge the influence of temperature on the viscosity of follower pistons, the viscosity of the compositions was measured at 20° C. and at 50° C.

These measurements were performed using a Haake Rheostress RS 150 flow meter provided with a 20 mm cone/plane system, having a shear gradient of 1 $s^{-1}$.

b) Hardness

The influence of temperature on the hardness of the gel follower pistons in Examples 1 to 14 was determined by measuring variations in hardness by means of a Petrotest PNR10 penetration meter fitted with a 102.5 g cone and a 47.5 g guide.

The results of the tests are expressed as a % variation in viscosity or hardness between 20° C. and 50° C. using the following scale:

4: 20° C.–50° C. variation≦5%

3: 5%<20° C.–50° C. variation≦10%

2: 10%<20° C.–50° C. variation≦20%

1: 20%<20° C.–50° C. variation≦30%

0: 20° C.–50° C. variation≦30%

Behavior of Follower Piston in Tube

In order to verify whether the follower piston stays in place in the tube regardless of storage conditions (position, temperature), thus ensuring that ink does not flow out, each ball-point pen was placed point up in air in an oven thermostatic at 55° C.

The pens were examined after being stored for 1 week, and were marked on the following criteria:

4: no withdrawal of the ink+follower piston system

3: slight withdrawal of the ink+follower piston system

2: withdrawal and/or deformation of the ink+follower piston system

1: major withdrawal and/or deformation of the ink+follower piston system

0: ink flowed out of the rear of the tube

Overall Average Score for the Follower Piston

This is the arithmetic mean of the scores characteristic of each test.

The results of all of these tests are given in Table 3.

TABLE 3

Results of tests performed on single- and dual-component follower pistons

| | Viscosity of initial liquid medium | Hardness of final gel at 25° C. | Voland hardness of final gel | Method | Flow rate regularity | Appearance | Interface | Resistance to impact | Influence of temperature | Behavior of tube ↑ at 50 ° C. | Average score |
|---|---|---|---|---|---|---|---|---|---|---|---|
| Example 1 | 1360 mPa · s | 332 $10^{-1}$ mm | 5.2g | 4 | 3 | 3 | 4 | 4 | 3 | 4 | 3.6 |
| Example 2 | 950 mPa · s | 345 $10^{-1}$ mm | 4.3g | 4 | 4 | 3 | 4 | 3 | 3 | 3 | 3.4 |
| Example 3 | 1280 mPa · s | 277 $10^{-1}$ mm | 10.9g | 4 | 3 | 3 | 4 | 3 | 4 | 3 | 3.4 |
| Example 4 | 2215 mPa · s | 255 $10^{-1}$ mm | 14.8g | 3 | 3 | 3 | 3 | 3 | 4 | 4 | 3.3 |

TABLE 3-continued

Results of tests performed on single- and dual-component follower pistons

| | Viscosity of initial liquid medium | Hardness of final gel at 25° C. | Voland hardness of final gel | Method | Flow rate regularity | Appearance | Interface | Resistance to impact | Influence of temperature | Behavior of tube ↑ at 50 ° C. | Average score |
|---|---|---|---|---|---|---|---|---|---|---|---|
| Example 5 | 1350 mPa · s | 295 $10^{-1}$ mm | 8.5g | 4 | 3 | 3 | 3 | 3 | 3 | 4 | 3.3 |
| Example 6 | 1400 mPa · s | 281 $10^{-1}$ mm | 10.3g | 4 | 4 | 3 | 4 | 4 | 4 | 4 | 3.8 |
| Example 7 | 1110 mPa · s | 302 $10^{-1}$ mm | 7.7g | 4 | 4 | 4 | 4 | 4 | 3 | 4 | 3.8 |
| Example 8 | 1090 mPa · s | 325 $10^{-1}$ mm | 5.6g | 4 | 4 | 4 | 4 | 4 | 4 | 4 | 4.0 |
| Example 9 | 1690 mPa · s | 100 $10^{-1}$ mm | 126.2g | 3 | 3 | 3 | 4 | 3 | 3 | 4 | 3.4 |
| Example 10 | 1540 mPa · s | 400 $10^{-1}$ mm | 2.0g | 4 | 3 | 3 | 3 | 3 | 3 | 3 | 3.1 |
| Example 11 | 1325 mPa · s | 306 $10^{-1}$ mm | 7.3g | 4 | 3 | 3 | 4 | 3 | 4 | 4 | 3.6 |
| Example 12 | 1568 mPa · s | 318 $10^{-1}$ mm | 6.2g | 4 | 3 | 3 | 4 | 3 | 3 | 3 | 3.3 |
| Example 13 | 1230 mPa · s | 327 $10^{-1}$ mm | 5.5g | 4 | 4 | 3 | 4 | 3 | 4 | 4 | 3.7 |
| Example 14 | 1290 mPa · s | 315 $10^{-1}$ mm | 6.5g | 4 | 4 | 4 | 4 | 4 | 4 | 4 | 4.0 |
| Comparative Example 1 | 185225 mPa · s | >400 $10^{-1}$ mm | <2.0g | 2 | 3 | 2 | 2 | 3 | 4 | 3 | 2.7 |
| Comparative Example 2 | 284885 mPa · s | >400 $10^{-1}$ mm | <2.0g | 1 | 2 | 0 | 1 | 1 | 0 | 0 | 0.7 |

What is claimed is:

1. A follower piston for a ball-point pen, the piston comprising an element in the form of a stable gel of hardness measured by cone penetration lying in the range $100\times10^{-1}$ mm to $400\times10^{-1}$ mm.

2. A follower piston according to claim 1, characterized in that the gel element is made from a reaction medium containing at least one liquid component selected from silicone polymers, polyurethanes, polyesters, and epoxy resins.

3. A follower piston according to claim 2, characterized in that the reaction medium contains a first liquid component (A) and a second liquid component (B) of the same chemical nature and suitable for participating in a condensation or addition chemical reaction.

4. A follower piston according to claim 3, characterized in that the chemical reaction is hydrosilylation.

5. A follower piston according to claim 3, characterized in that the first liquid component (A) is constituted by at least one silicon polymer provided with at least two unsaturated ethylene functions.

6. A follower piston according to claim 5, characterized in that the unsaturated ethylene functions are located at both ends of chains of the silicone polymer of the first components (A).

7. A follower piston according to claim 3, characterized in that the second liquid component (B) is constituted by at least one silicon polymer provided with at least two Si—H functions.

8. A follower piston according to claim 7, characterized in that said silicone polymer having Si—H functions is a dimethylsiloxane and methylhydrosiloxane copolymer.

9. A follower piston according to claim 7, characterized in that the molar ratio in the reaction medium of the unsaturated ethylene functions of the first component (A) and of the Si—H functions of the second component (B) lies in the range 1:5 to 5:1.

10. A follower piston according to claim 9, characterized in that the ratio of unsaturated ethylene functions to Si—H functions lies in the range 1:3 to 3:1.

11. A follower piston according to claim 2, characterized in that the follower piston includes a hydrosilylation agent (C) based on platinum at a concentration such that the platinum content lies in the range 0.1 ppm to 1000 ppm.

12. A follower piston according to claim 2, characterized in that the follower piston includes a diluant agent (I) constituted by at least one inert silicone polymer such as trimethylsiloxy-terminated poly(dimethylsiloxane).

13. A follower piston according to claim 2, characterized in that the follower piston includes at least one lubricating agent (E) selected from white mineral oils and isoparaffin oils and/or fatty materials such as fatty acid esters, fatty alcohol esters, and triglycerides.

14. A follower piston according to claim 13, characterized in that the quantity of lubricating agent (E) lies in the range 0.1% to 20% by weight of the gel, and lies preferably in the range 0.2% to 12% by weight.

15. A follower piston according to claim 2, characterized in that the follower piston includes a wetting agent (F) constituted by at least one derivative selected from silicone derivatives, fluorine derivatives, and phosphate derivatives.

16. A follower piston according to claim 15, characterized in that said wetting agent (F) is present in the gel in a quantity lying in the range 0.01% to 10% by weight of the gel, and preferably in the range 0.1% to 5% by weight.

17. A follower piston according to claim 2, characterized in that the follower piston further includes a mineral filler (D) constituted by finely divided silica present in a quantity lying in the range 0.1% to 20% by weight.

18. A follower piston according to claim 17, characterized in that the finely divided silica is present in a quantity lying in the range 0.5% to 10% by weight.

19. A follower piston according to claim 2, characterized in that the follower piston further includes dyes or pigments (G) in a quantity lying in the range 0.1% to 20% by weight.

20. A follower piston according to claim 19, characterized in that the dyes or pigments (G) are present in a quantity lying in the range 0.5% to 10% by weight.

21. A follower piston according to claim 1, further comprising an at least partly immersed porous solid element, the solid element being formed by a bar of extruded plastics material obtained from a mixture of an expansion agent and at least one component selected from polyolefins, polystyrene, and ABS.

22. A follower piston according to claim 21, characterized in that said expansion agent is azodicarbonamide.

23. A follower piston according to claim 1, further comprising an at least partly immersed porous solid element, the solid element being formed by thermoadhered high molecular weight polyethylene powder.

24. A method of making a follower piston having an element in the form of a stable gel of hardness measured by cone penetration lying in the range $100\times10^{-1}$ mm to $400\times10^{-1}$ mm, for use in a pen of the type having an ink-reservoir forming tube fitted at one end with a ball-point carrier and a ball point, the method being characterized in that:

a liquid reaction medium is introduced into the tube via its open end remote from the point and above the ink; and the gel element is produced by the liquid medium reacting chemically in situ.

25. A method of making a follower piston according to claim 24, characterized in that a catalyst is added while the liquid reaction is introduced.

26. A method of making a follower piston according to claim 24, characterized in that a solid element is formed and is subsequently introduced into the tube and into the liquid medium.

27. A method according to claim 24, characterized in that the reaction medium is prepared by mixing a first liquid component (A) with a second liquid component (B) in such a manner as to obtain a viscosity lying in the range 10 mPa.s to 10,000 mPa.s.

28. A method according to claim 24, characterized in that gelling of the liquid medium is accelerated by heat treatment at a temperature lying in the range 50° C. to 80° C. for length of time lying in the range a few minutes to a few hours.

29. A follower piston for a ball-point pen, characterized in that the follower piston comprises a liquid or gel element in which a solid element having an array of open pores is introduced at least in part.

30. A follower piston according to claim 29, characterized in that the apparent density of the solid element lies in the range 0.5 to 1.0.

31. A follower piston according to claim 29, characterized in that said solid element is constitued by theremoadhered high molecular weight polyethylene powder.

32. A follower piston according to claim 29, characterized in that the solid element is constituted by a polyurethane foam.

33. A follower piston according to claim 29, characterized in that the density of the solid element is less than that of the liquid or gel element.

34. A follower piston according to claim 29, characterized in that the density of the liquid or gel element lies in the range 0.8 to 1.1.

35. A follower piston for a ball-point pen, the piston comprising an element in the form of a liquid element and an at least partly immersed porous solid element, the solid element being formed by a bar of extruded plastics material obtained from a mixture of an expansion agent and at least one component selected from polyolefins, polystyrene, and ABS, the solid element having a hardness measured by cone penetration lying in the range $100\times10^{-1}$ mm to $400\times10^{-1}$ mm.

36. A follower piston according to claim 35, characterized in that said expansion agent is azodicarbonamide.

37. A method of making the follower piston according to claim 35, characterized in that said solid element is formed and is subsequently introduced into the liquid element.

38. A follower piston for a ball-point pen, the piston comprising an element in the form of a liquid element and an at least partly immersed porous solid element, the solid element being formed by thermoadhered high molecular weight polyethylene powder the solid element having a hardness measured by cone penetration lying in the range $100\times10^{-1}$ mm to $400\times10^{-1}$mm.

* * * * *